US007942397B2

(12) United States Patent
Ramseier

(10) Patent No.: US 7,942,397 B2
(45) Date of Patent: May 17, 2011

(54) METHOD AND DEVICE FOR OPENING PRINTED PRODUCTS

(75) Inventor: Marcel Ramseier, Wetzikon (CH)

(73) Assignee: Ferag AG, Hinwill (CH)

( * ) Notice: Subject to any disclaimer, the term of this patent is extended or adjusted under 35 U.S.C. 154(b) by 435 days.

(21) Appl. No.: 12/121,927

(22) Filed: May 16, 2008

(65) Prior Publication Data

US 2008/0284084 A1 Nov. 20, 2008

(30) Foreign Application Priority Data

May 16, 2007 (CH) ..... 0794/07

(51) Int. Cl.
*B65H 5/30* (2006.01)

(52) U.S. Cl. ..... 270/52.22; 270/52.15; 270/52.16; 270/52.19; 270/52.23; 270/52.25; 270/52.29; 270/52.3; 270/52.26; 270/52.27

(58) Field of Classification Search ..... 270/52.14, 270/52.15, 52.16, 52.19, 52.2, 52.22, 52.23, 270/52.25, 52.29, 52.3, 52.26, 52.27
See application file for complete search history.

(56) References Cited

U.S. PATENT DOCUMENTS

| | | | | |
|---|---|---|---|---|
| 3,591,165 | A * | 7/1971 | McCahon et al. | 270/52.29 |
| 3,661,379 | A | 5/1972 | Dolfini | |
| 4,078,784 | A | 3/1978 | Miaskoff et al. | |
| 4,373,710 | A | 2/1983 | Hansen et al. | |
| 4,743,005 | A | 5/1988 | Reist | |
| 5,292,111 | A | 3/1994 | Hansch | |
| 5,474,285 | A * | 12/1995 | Stauber | 270/52.24 |
| 5,613,669 | A * | 3/1997 | Grueninger | 270/52.06 |
| 5,647,588 | A | 7/1997 | Stauber et al. | |
| 5,782,465 | A | 7/1998 | Rawlings et al. | |
| 5,887,863 | A * | 3/1999 | Hollenstein et al. | 270/52.18 |

FOREIGN PATENT DOCUMENTS

| | | |
|---|---|---|
| CH | 418 297 | 8/1966 |
| DE | 37 05 257 A1 | 10/1987 |
| EP | 0 518 063 A1 | 12/1992 |

* cited by examiner

*Primary Examiner* — Leslie A Nicholson, III
(74) *Attorney, Agent, or Firm* — Rankin, Hill & Clark LLP

(57) ABSTRACT

A device for opening folded or bound printed products, comprises a feeder device (2, 13) for feeding-in individual folded or bound sub-products (4) and an opening device (6) for opening the sub-products (4), as well as furthermore an opening verifying installation (11, 14, 15, 16), in order to with optical means (14) identify deficiently opened sub-products (4) before the sub-products (4) are further processed. In case of sub-products (4) identified as being deficiently opened, the further processing is not carried out, but rather a deficiently opened sub-product (4) is conducted back to the opening device once more.

15 Claims, 7 Drawing Sheets

METHOD AND DEVICE FOR OPENING PRINTED PRODUCTS

BACKGROUND OF THE INVENTION

The invention is related to a method and a device for opening folded or bound printed products in accordance with the preamble of the corresponding independent claims.

DESCRIPTION OF RELATED ART

Devices for collecting or inserting printed products or sub-products are generally known. In this, individual or several folded paper sheets are, one after the other, placed on top of each other or inserted between one another. For this purpose, the sheets or sub-products, which are to be laid on or which are to be inserted, have to be opened. This opening, as a rule, takes place very reliably. In exceptional cases, however, in is possible that the opening device fails. This may have the consequence in a following step that sub-products fall into the machine in an uncontrolled manner.

Similar problems quite generally occur, when a sub-product has to be opened for further processing or finishing, e.g., for the sticking in of an enclosure or a label on one side of a printed product. A sub-product to be opened may be a folded or a bound product, regardless of the precise type of binding (stitched binding or adhesive binding, etc.).

U.S. Pat. No. 5,782,465 describes an opening device for a magazine lying and being conveyed horizontally. The magazine is opened at a fixed spear. A first reflective light barrier verifies, whether the upper part has really been lifted off and is lying on an upper part of the conveyor track, a second one verifies, whether the lower part is still lying on a lower part of the conveyor track.

CH 418 297 demonstrates a folded sheet feeder with an opening device and a detecting device, as to whether the two parts of a sheet to be opened slide past in front of and behind a saddle. The detection takes place by means of two mechanical sensor switches, one respectively for each sheet side. As alternatives to mechanical switches, also pneumatically or photo-electrically actuated switches are mentioned.

U.S. Pat. No. 4,078,784 describes an opening device for printed sheets folded once up to several times, before these are placed onto a saddle of a collecting device. The opening of the printed sheets takes place by means of rotating drums, one of which grasps one side of the printed sheet with a gripper. For checking this grasping, the thickness of the sheet grasped by the gripper is measured indirectly. As a result, the gripper position is mechanically transmitted to a reflector, the position of which is detected by a light barrier. Because the gripper rotates along with the drum, the detecting is mechanically synchronised with the rotation of the drum.

BRIEF SUMMARY OF THE INVENTION

It is therefore the object of the invention to create a method and a device for opening folded or bound printed products of the type mentioned at the beginning, which avoid the effects of opening errors.

This objective is achieved by a method and a device for opening folded or bound printed products with the characteristics of the corresponding independent claims.

Thus, on the one hand it is detected, whether a folded sub-product has been opened prior to the further processing, and, if this is not the case, instead of the further processing the sub-product is conducted to a special treatment. In the normal case, therefore when the sub-product is correctly opened, the further processing is carried out. The further processing, for example, may be the collecting of the opened sub-product on a further sub-product, or the inserting of a further sub-product into the opened sub-product, or the sticking-in of an enclosure into the opened sub-product, etc. An only partial opening, or a completely missing opening, or other opening defects are, in summary, designated as defective or deficient openings, and shall lead to the detection of an opening error.

A sub-product may be a single folded sheet, or a bundle of several already collected and folded sheets, or a bound printed product as a part of a booklet, of a book, of a brochure or of a newspaper. The special treatment, in preference, consists of the sub-product being conveyed back on a circulating conveying device, so that in a renewed pass it is once more conducted to the opening device. For example, the circulation conveying device is a chain of grippers, which are individually controllable. If therefore it is detected, that a sub-product, held by the gripper, has passed the opening device and has not been opened, the gripper does not release the sub-product for the normal further processing, but carries it back again. The carried back sub-product is subsequently ejected and removed, or else conducted back to the opening device. In doing so, a feeder device which supplies the grippers with the sub-products, in preference is controlled in such a manner, that the gripper, which is already holding the returned sub-product, is not supplied.

During the collecting, a first sub-product is fed-in and opened, in order to be placed on another, second sub-product, which, for example, is lying on a saddle of a collecting conveyor or on a collecting drum. In doing so, the second sub-product together with the saddle may be moved transverse to the direction of folding, respectively, saddle direction, and/or the second sub-product may be displaced along the saddle in the saddle direction. Here, thus in preference, the not opened sub-product is subjected to a special treatment, inasmuch as it is not placed—because in the opened condition it is not possible for it to be correctly placed, but rather it would fall down past the second sub-product. The further special treatment of the first sub-product then possibly may be, that it is conducted back again or ejected. The second sub-product may also be subjected to a special treatment, inasmuch, for example, that—depending on the construction of the collector—it is conducted back or ejected. If the collector therefore allows a sub-product to be conducted back within the collector and opened again, then the collector is also considered as a circulating conveying device. The second, incomplete sub-product may also be conducted onwards and processed, in doing so, however, it is preferably marked as defective by the controlling software and ejected at a suitable later point in time.

When inserting, the first sub-product to be opened is opened in an inserting device, for example, in an inserting drum, and a second sub-product is fed-in and inserted into the first one. Here, therefore, the first sub-product has to be opened, so that the inserting takes place correctly and so that the combined sub-products do not fall apart again at a later point in time. If the first sub-product is identified as not opened, also here there are various possibilities: For example, the second sub-product is not inserted and/or it is conducted back again. The first, opened sub-product in preference is conducted back again, in order to be opened in a second pass, providing the construction of the inserting device allows this, or else marked as defective in the control and later ejected.

In case of other processing steps, which call for the previous opening of the sub-product, in an analogous manner a special treatment is carried out instead of a treatment provided for the normal case. In doing so, in particular the normal processing step is not carried out and the unopened sub-product is conducted back for a renewed opening operation.

In a preferred embodiment of the invention, first sub-products conducted back again are once more conducted back to the respective opening device, and it is detected, whether they are again not opened in this further pass. Only when a sub-product, after a predefined number of passes, has not been opened is it marked as defective and ejected. The ejecting takes place, in that the sub-product is removed form the (sub-) product stream at a point provided for this purpose.

In a preferred embodiment of the invention, the feeding-in device itself is a circulating conveying device, and comprises a plurality of holding means for the simultaneous transporting, respectively, conveying of a plurality of sub-products. The holding means, for example, are grippers or insertion pockets. The feeding-in device itself is, therefore, designed to conduct defectively opened sub-products back to the opening device once again. In case of a circulating gripper chain, this signifies that the gripper, after the detection of a deficient opening, does not release the respective sub-product for collection, but in preference conducts it back again and then once more conducts it to the opening device. In case of an inserting device, this signifies that a deficiently opened sub-product is not conveyed out of the inserting pocket, but preferably left in the inserting pocket and conveyed back to the opening device again.

The detection as to whether a sub-product has been opened, in preference, takes place with the help of one or of several optical sensors. An optical sensor of this kind in particular is a brightness sensor, a sensor line or a camera. An individual brightness sensor in preference comprises a defined sensing range, for example, a dot-shaped sensing area or a line-shaped sensing area. A sensor row, similar to a camera, preferably by means of an imaging lens, captures a line-shaped view of the conveyed sub-products, wherein individual sections of the line provide respectively assigned sensor values.

The sensor is, or the sensors are, capable of monitoring the conveyed sub-products by means of continuous measurements, and, from the progression of the sensor signal or signals over time, of determining the opening condition. The bright/dark distribution of the sensing range of a sensor, which is directed at the conveyed sub-products (or more generally expressed, the image recorded by the sensor), respectively changes at the clocking cycle of the conveying device. As long as the sub-products are all in the same, opened condition, the sensor values are repeated periodically. This periodically repeated course of values is stored as a reference. If a sub-product is not opened, then during a corresponding period, deviating sensor values are present. This deviation over the course of time is identified by an analogue or digital evaluation of the sensor values, and a defective opening of the corresponding sub-product is signaled. In preference, in accordance with the type of deviation it is also determined in what manner the opening is deficient, therefore whether the sub-product, for example, is lying wrongly with its leading or its trailing side. For the simplifying of the evaluation of the periodical signals, it is possible that the evaluation is synchronised with the movement of the sub-products by a clocking signal of the conveying device. This procedure just described is possible for the evaluation of data from all sensors described (individual sensors, line sensors, camera) and combinations of these sensors. In this case, therefore continuous measurements with a clocked evaluation take place.

Alternatively, the sensor or the sensors may observe the conveyed sub-products only at certain points in time, wherein these points in time are predetermined by the clocking cycle of the conveying device. In accordance with this second variant, the sensor data are read always at a point in time (relative to a clocking period), in which a sub-product should be at a certain point in space. The sensor data then, in preference, are compared with reference values, stored in memory, which correspond to an error-free condition. If the deviation exceeds a predefined value, a deficient opening is signaled. This procedure is possible for the evaluation of data from all sensors described (individual sensors, line sensors, cameras) as well as combinations of these sensors. In this case therefore clocked measurements with a clocked evaluation take place.

Notwithstanding the clocking of the measurements, the reliability or the meaningfulness of the measurements is in preference increased by utilising several sensors. For example, it is possible to separately and specifically monitor the position of the leading and of the trailing half of the opened sub-product.

In further preferred embodiments of the invention, the meaningfulness of the sensor signals is increased, in that the background or a part of the background range detected by the sensors is optically particularly emphasized. This, for example, may take place by the background being lit and/or specially marked by color or else coated with a well reflecting material. In doing so, within the spectral range, in which the sensors are particularly sensitive, the background shall differ as strongly as possible from the sub-products. Operating ranges of the sensors preferably shall be within the visible range or in the infrared range or ultraviolet range or within a combination of these ranges.

The explanations up to now are applicable independent of the conveying direction of the sub-products: Sub-products, during the detecting of the sensor data, may be therefore conveyed in parallel or diagonally relative to the fold of the sub-products.

In a preferred embodiment of the invention, the reference values utilised in the error-free operation of the installation are determined and stored in memory. It is furthermore also possible to automatically adapt the continuously detected measured values of correctly opened sub-products in the course of normal operation. This is applicable for sensors which provide only a single measured value, as well as for sensor arrays and cameras. With this, it is possible to take into account the ageing and contamination with dirt of the installation.

Further preferred embodiments follow from the dependent claims. In this, the characteristics of the method claims are combinable in the sense of the device claims and vice versa.

BRIEF DESCRIPTION OF THE DRAWINGS

In the following, the object of the invention is explained in more detail on the basis of preferred examples of embodiments, which are illustrated in the attached drawings. These respectively schematically depict.

The reference marks utilised in the drawings and their significance are listed in summary on the list of reference marks. On principle, in the Figures the same parts are designated with the same reference marks.

DETAILED DESCRIPTION OF THE INVENTION

Figure 1:
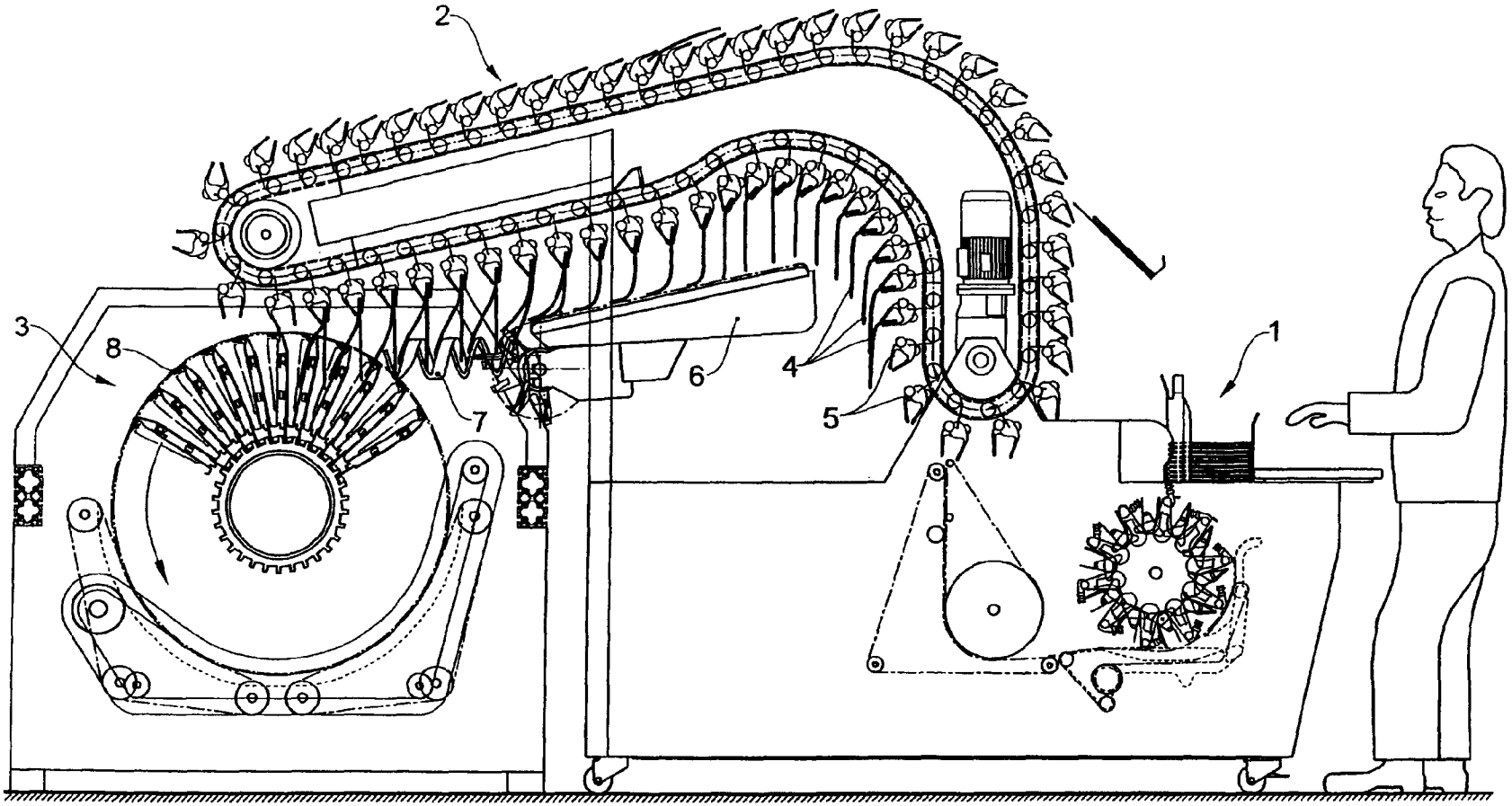
FIG. 1 a collecting device.

FIG. 1 illustrates a collecting device with a feeder unit 1, a circulating gripper chain 2 and a collecting drum 3. The feeder unit 1 conveys folded paper sheets 4 to grippers 5 of the gripper chain 2 as sub-products. The gripper chain 2 conducts the sheets 4 over an opening device 6, which by means of a belt running faster pulls the leading edge of the sheets 4 to the left and so opens the sheets. After the opening device 6, the sheets 4 are kept opened by a spiral 7 running synchronously with the grippers 5 and acting as a means to keep the sheets opened, before they are placed onto saddles 8 of the collecting drum 3 and released.

Sensors for verifying the opening, in preference, are arranged within an area of the spiral 7 or of the saddles 8, in which the grippers 5 have not yet released the sheets 4. If a deficient opening is detected, the corresponding gripper 5 is not opened, but the sheet 4 is conducted back by the gripper chain 2. The feeder unit 1 thereupon is controlled in such a manner, that the gripper 5 with the returned sheet 4 is not opened and is not re-supplied with a further sheet. The sheet 4 conducted back may also be deposited into a compartment at the supply point, so that at a later point in time it is able to be introduced into the process once more either manually or automatically, if so required following an inspection.

Various embodiments of the invention are explained in part in context with this collecting device, they are, however implementable in an analogue manner in the case of other collecting or inserting devices or generally in devices for the processing or handling of opened (sub-) products.

Figure 2:
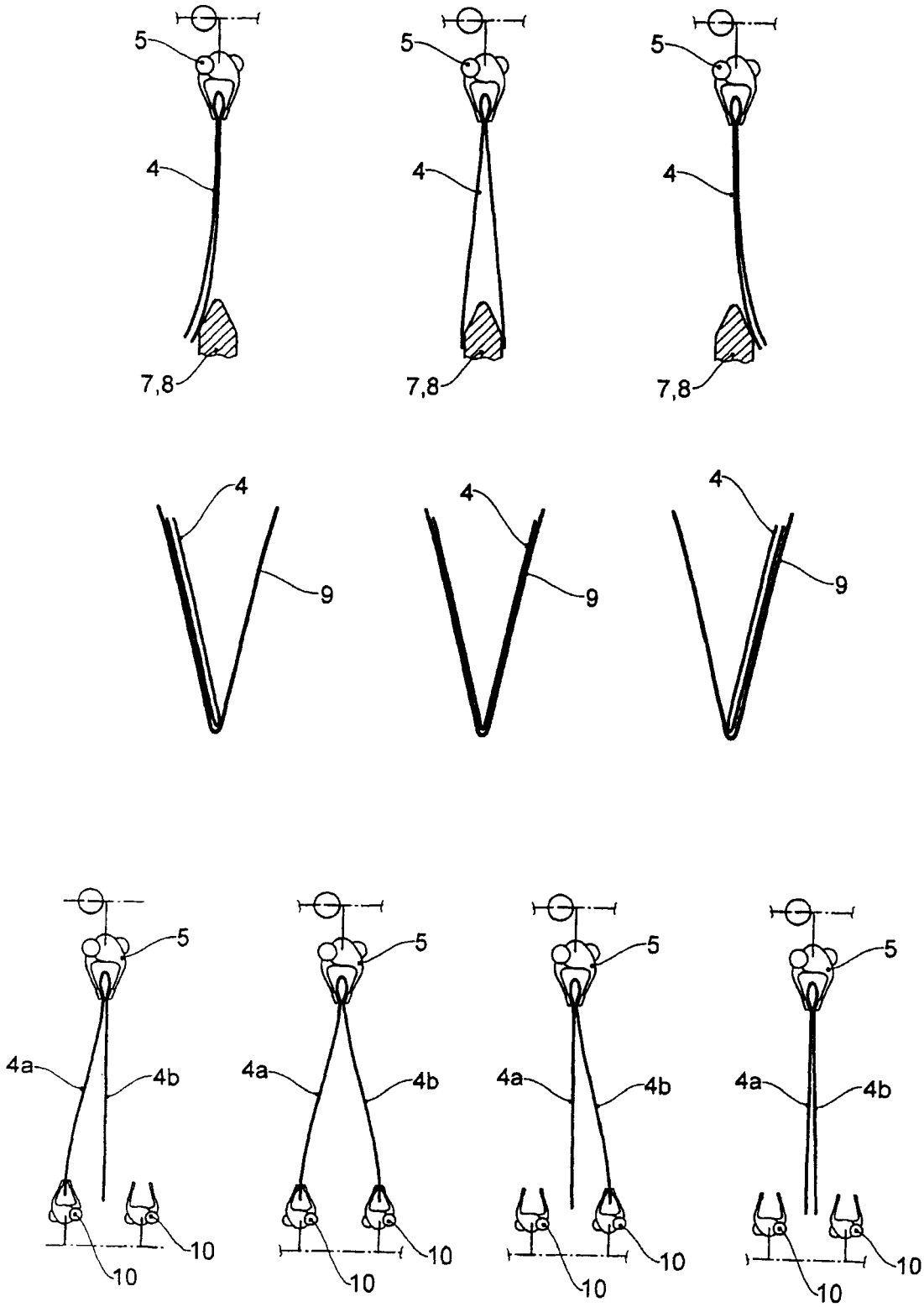
FIG. 2 various opening errors.

FIG. 2 schematically depicts various opening errors during collecting (upper line) and during inserting (second line). A sub-product 4, during collecting, may come to lie correctly (middle column) or with both halves to the left or right of a saddle 8 or of the spiral 7. During inserting, the sub-product 4 may also come to lie correctly (middle column) or with both halves to the left or right in a compartment 9 of an inserting device. The third line illustrates sub-products 4, which on the one hand are held at the fold by grippers 5 and on the other hand are kept opened by means of keeping opened, such as clamps 10 running along with them. Here a correct manner of keeping open is shown in the second column, and to the left and right of it error situations, in which the right-hand half of the sheet 4*b*, respectively, the left-hand half of the sheet 4*a* is not held. In addition, completely on the right the further error condition is also depicted, in which none of the sheet halves 4*a*, 4*b* are being held.

Figure 3:
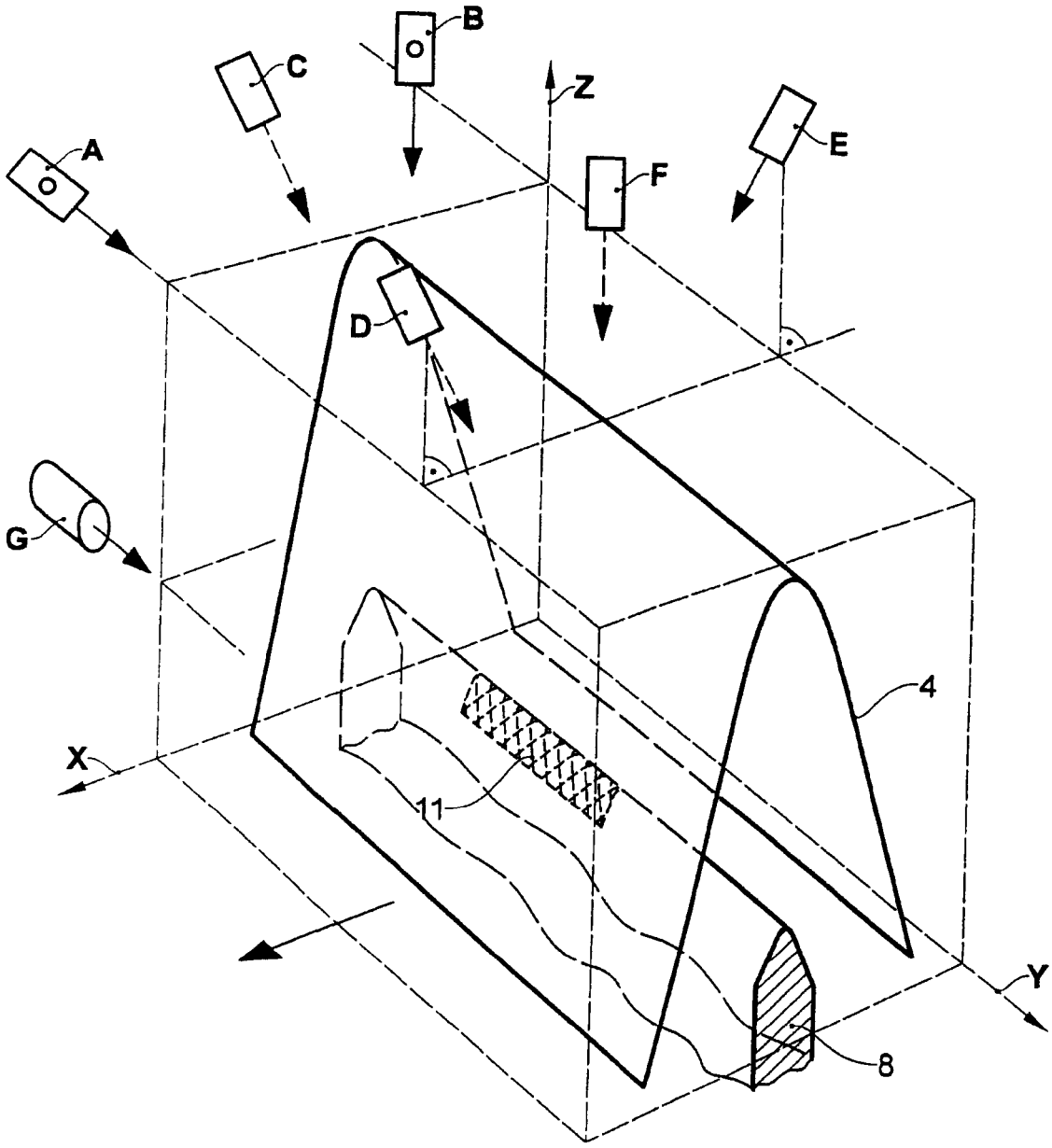
FIGS. 3-5 various sensor arrangements.

FIG. 3 schematically illustrates various possible arrangements of sensors in the area of the spiral 7 or of a saddle 8. Depending on how the conveying device for the sub-products 4 is constructed, next to or above the sub-products 4, space remains for arranging the sensors. In the following, the construction of the conveying device is not dealt with—it goes without saying, that the arrangement of the sensor or of the sensors utilised has to be selected accordingly.

First of all, sensor positions preferred in principle are defined, and subsequently preferred sensor types and the data evaluation are dealt with: The direction of the fold of the sub-product 4 defines a y-axis, and, in the horizontal plane vertical to it, an x-axis. Vertically to both, there is a z-axis. The sub-product 4 is typically conveyed in the x-direction, also in the case of a conveyance in y-direction it may be checked, respectively, monitored for opening errors. The position of the conveyed sub-product 4 is assumed to be in the reference position shown.

The preferred sensor positions, for future reference, are designated with the following letters:

A: Position: In y-direction next to the sub-product 4, in z-direction above the middle of the sub-product 4 or above the sub-product 4. Orientation: Starting out from the y-direction twisted in negative x-direction and pointing downwards, in preference in the direction towards a background element moved along with the conveying device or of the collecting or inserting device.

B: Same as A, but with the orientation twisted in positive x-direction.

C: Same as A, but with the orientation essentially vertical to the x-direction.

D: Same as A, but with the position in y-direction lying above the sub-product, and the orientation in the negative x-direction and pointing downwards.

E: Same as D, but with the orientation in the positive x-direction and pointing downwards.

F: Same as D and E, but essentially pointing vertically downwards.

G: Position: In the y-direction next to the sub-product 4, in the z-direction approximately in the area of the middle of the sub-product. Orientation: Essentially in the y-direction.

Figure 4:
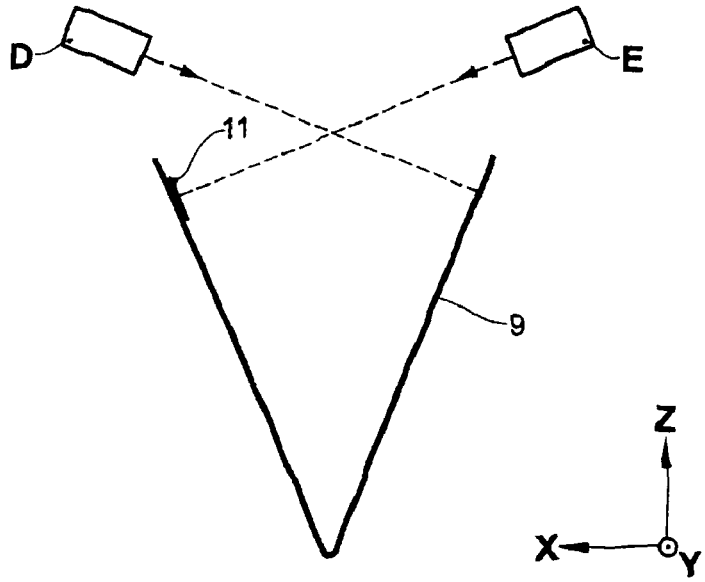
Figure 5:
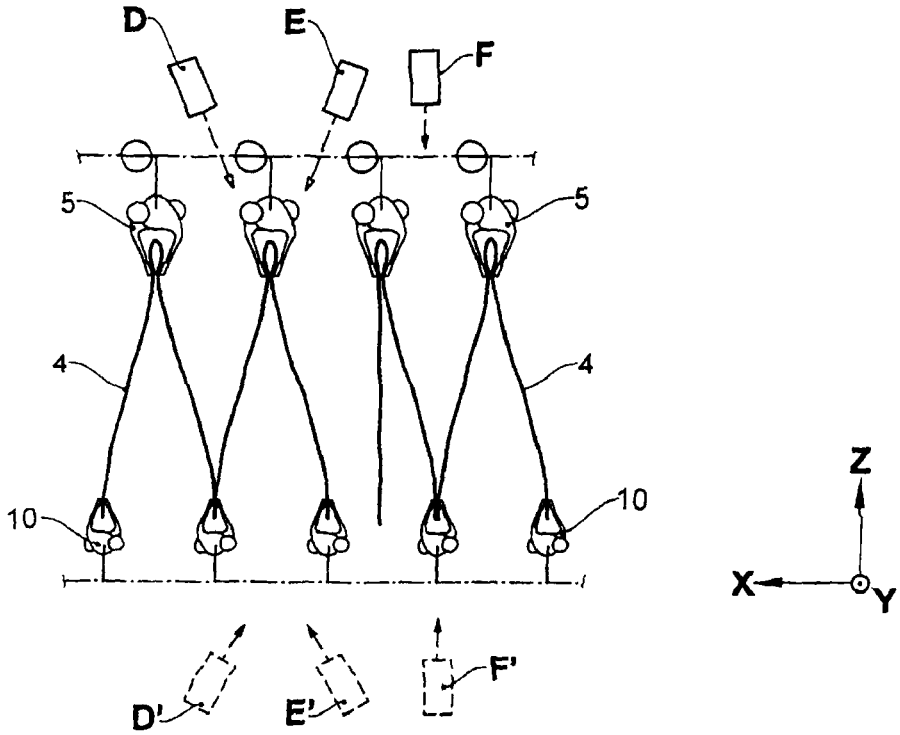

FIG. 4 separately depicts the positions D and E relative to an inserting compartment 9 with reflecting means 11, and FIG. 5 the positions D, E, F, G relative to a conveying device with keeping opened clamps 10 that move along with the conveying device. Further preferred arrangements D', E', F result from mirroring the positions on the x-y-plane, indicated as dashed in FIG. 5, and/or by a slanting direction of view corresponding to the positions A, B, C.

In each of the exemplary positions A-F, it is, in principle, possible for the sensors to be one of the following types:

- Passive brightness sensor, in preference with a fanned-open detecting range, which, for example, covers approximately the width of the opened sub-product, and furthermore preferably is in association with an optically emphasised element in the background of the detected range or on the spiral 7 or on the saddle 8;
- reflected light barrier, in preference with a retro-reflective layer on the spiral 7 or on the saddle 8 or a (not depicted) background;
- transmitted light barrier, with a light source located opposite relative to the sub-product 4;
- line sensor; preferably for the observation of a range extending in the x-direction; or
- video-camera or single picture camera.

As an example, in the following for individual combinations of sensor position and sensor type, the data evaluation is illustrated. Other combinations are also covered by the invention and in principle are capable of being implemented in the same manner.

Figure 6:
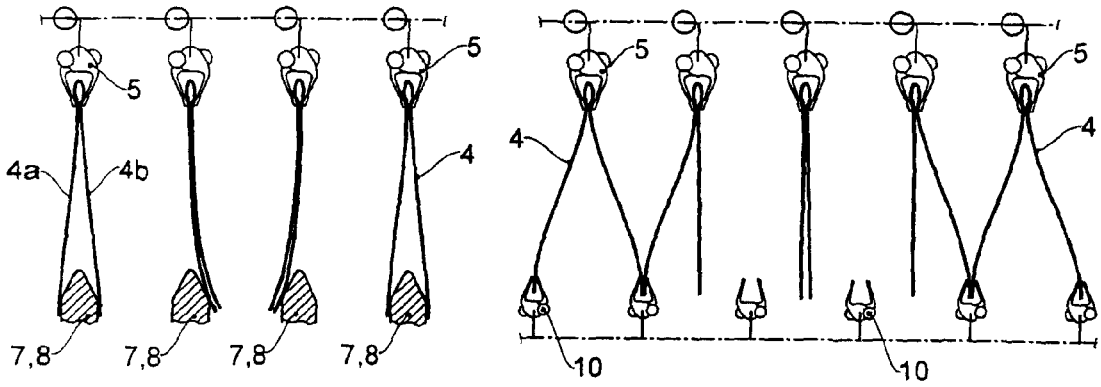
FIG. 6-10 opening errors and corresponding sensor signals.

FIG. 6 illustrates a sequence of sub-products 4 with and without opening errors, which are kept opened by means for keeping opened 7, 8 and 10 and conveyed from the right to the left. Also depicted are the sensor positions considered here, wherein it is understood, that in a real installation, typically sensors are only utilised in one or two of the positions. The left-hand part of the FIG. 6 depicts configurations, such as occur when the sub-products are lying on a spiral 7 or on a saddle 8, and which in preference are provided with means of reflection 11. The right-hand part shows configurations, such as occur during holding apart by keeping opened clamps 10.

FIGS. 7 to 10 each depict a corresponding course of the intensity of the recorded light, respectively, of the sensor signal, when this succession of sub-products passes by the sensors. In that, the sensors preferably comprise a narrow viewing angle or recording range, and are aligned to a light or reflective background. As in the case of a transmitted light barrier or of a reflected light barrier, therefore, in contrast to a brightness sensor with a wide detecting angle, preferably by means of a lens, only the light from a narrow angular range is detected. The evaluation, in preference, takes place by means of continuous measurements with a clocked evaluation. When a sensor senses one of the sub-products 4, the sensor signal drops. The sensor signals are preferably filtered in order to eliminate small irregularities. The vertical, dashed lines mark the point in time when the change to the next respective sub-product 4 occurs. This point in time is in preference either automatically established by analysis of the sensor signal itself or else derived from a clocking signal of the control system of the installation.

Figure 7:
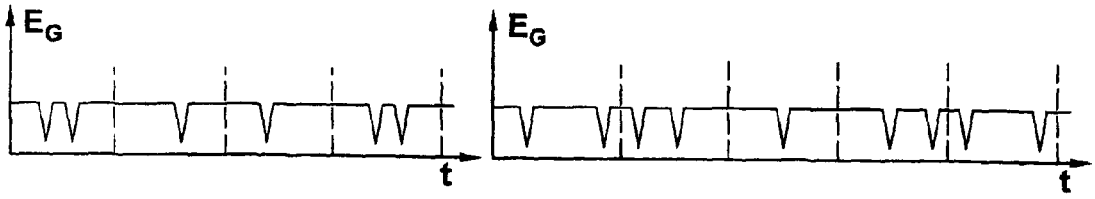

The individual sources correspond to the following sensor arrangements:

FIG. 7: Position G; in every clock cycle, the leading and the trailing half 4*a*, 4*b* respectively should lead to a decrease of the received intensity. If no pulse is present at all in then signal $E_G$, the absence of the sub-product 4 is concluded and a corresponding control signal may be triggered. If the sub-product 4 is lying on the spiral 7 or on a saddle 8 or another keeping opened means, then a simple evaluation rule is that, if only one decreasing pulse per clocking cycle is present, an error is signaled. From the temporal position of the missing pulse, it is possible to conclude whether the sub-product 4 is lying on the left or on the right. If the sub-product is kept opened by keeping opened clamps 10, then in case of an error the position of one of the pulses is displaced, or else, if the sub-product is being held neither on the left nor on the right, only a single pulse occurs.

Figure 8:
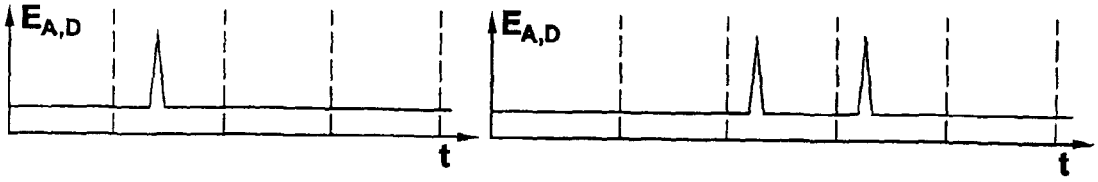

FIG. 8: Position A or D; in every clocking cycle the leading half 4*a* respectively should cover the background. In this, it is possible that the background is a stationary part of the installation, or else a moving part of the conveying device, therefore of the spiral 7, of a saddle 8 or of a conveying means of the keeping opened clamps 10. If the sensor signal $E_{A,D}$ does not decrease, respectively, if it unexpectedly increases, then it is concluded, that the leading half 4*a* is lying wrongly or that the sub-product 4 is completely missing.

Figure 9:
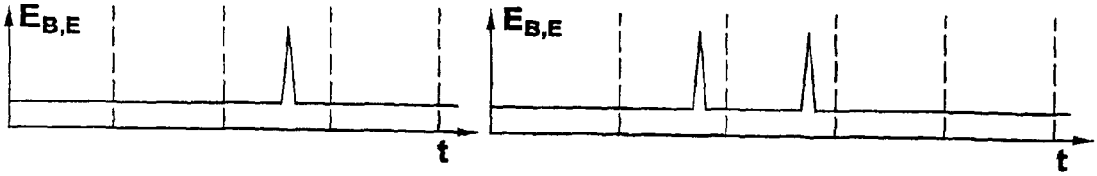

FIG. 9: Position B or E; the same as in the case of FIG. 8, with the difference, that respectively the trailing half 4*b* should cover the background. When viewed from above in accordance with the FIGS. 8 and 9, therefore in order to be able to detect both error cases leading/trailing and to be able to differentiate a complete lack of the sub-product 4, at least two sensors are necessary, one at A or D and the other one at B or E.

Figure 10:
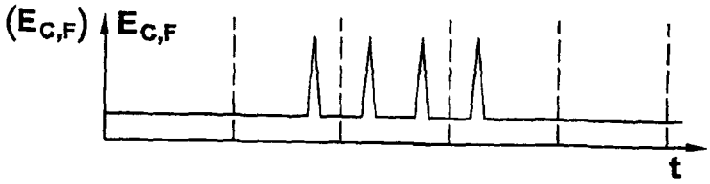

FIG. 10: Position C or F, wherein in the position C the sensor has to be located high enough for the background to be covered by the sub-product 4. Here in case of every error an increase of the signal intensity $E_{C,F}$ occurs, and from the position of the intensity pulse, relative to the clocking cycle it is possible to derive the type of error. From the length of the pulse the complete lack of the sub-product 4 can be concluded.

In the arrangement and evaluation of the sensors it is preferably taken into account that certain types of errors cannot occur at all, depending on the mode of operation of the opening device prior to the collecting or inserting.

A clocked evaluation instead of the continuous one is in preference utilised, if the anticipated temporal position of a pulse relative to the clocking cycle is precisely known, and a comparison of the light and dark intensities is not necessary. Then it is sufficient to sample the sensor value at this point in time and to evaluate it accordingly. In principle, however, the continuous measurement provides more information and enables a more robust evaluation.

Figure 11:
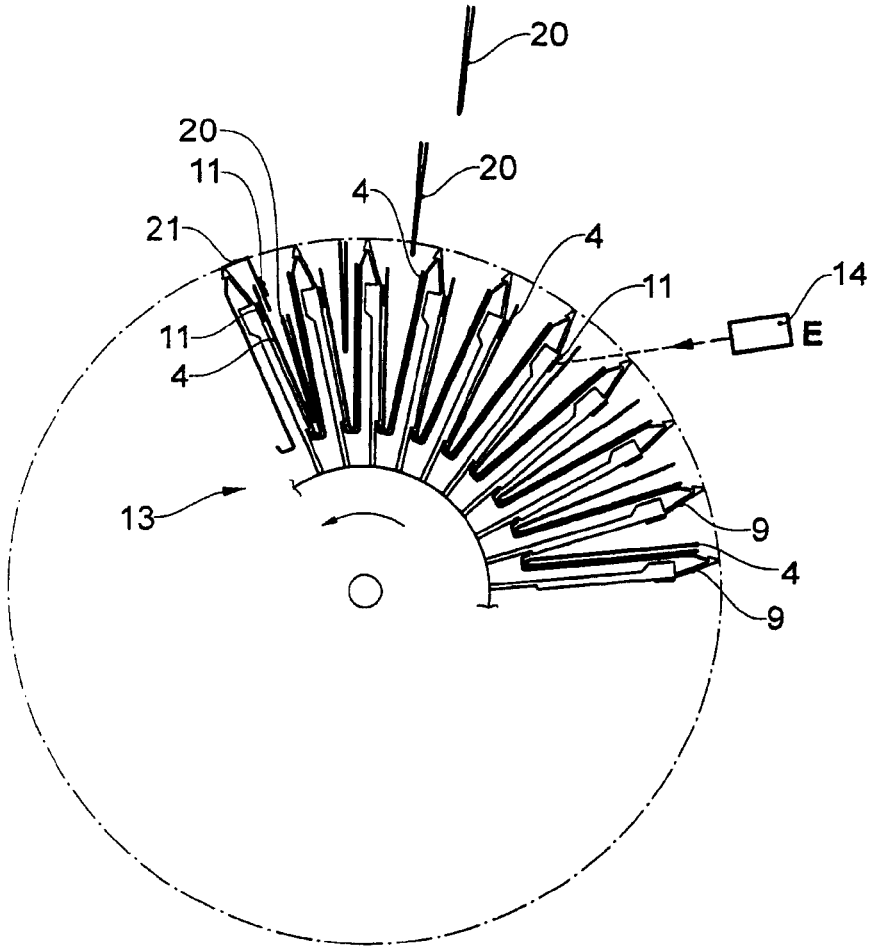
FIG. 11 an opening monitoring system in the case of an insertion device.

FIG. 11 schematically illustrates the monitoring of the opening condition of a sub-product 4 in an inserting drum 13 with inserting pockets 9. The drum rotates counter-clockwise. In the rising part, the sub-product 4 is opened by opening means (not indicated). On the basis of the force of gravity, it is only possible, that the error occurs that the sub-product 4 is lying on the right with both its halves. Therefore, it is sufficient to only check for this error, for example, with a sensor 14 in the position E or B, which is directed at that side of the pocket 9, on which the potentially missing (in this case the leading) half 4*a* should be lying. On this side, in preference, there is a reflective element 11, in order to increase the intensity difference to the sub-product 4. An intensity increase in case of a clocked or a continuous measurement therefore indicates a deficient opening. This is also applicable, if the sub-product 4 in the pocket 9 is conveyed past the point monitored by the sensor in a longitudinal direction, therefore parallel to the fold. Correspondingly, if the sub-product 4 is detected as not being properly opened, no further sub-product 20 is inserted. The not opened sub-product 4 is preferably left in the drum, ejected or conveyed to the opening device once again.

In a further preferred embodiment of the invention, after a further sub-product 20 has been inserted into the first sub-product 4, a cover 21 is flipped over the first sub-product 4 in the area of the monitored point 11. This cover 21 preferably comprises a reflective element 11 at the same location, so that after the opening of the further sub-product 20, it is possible to once again carry out a verification of the opening.

Figure 12:
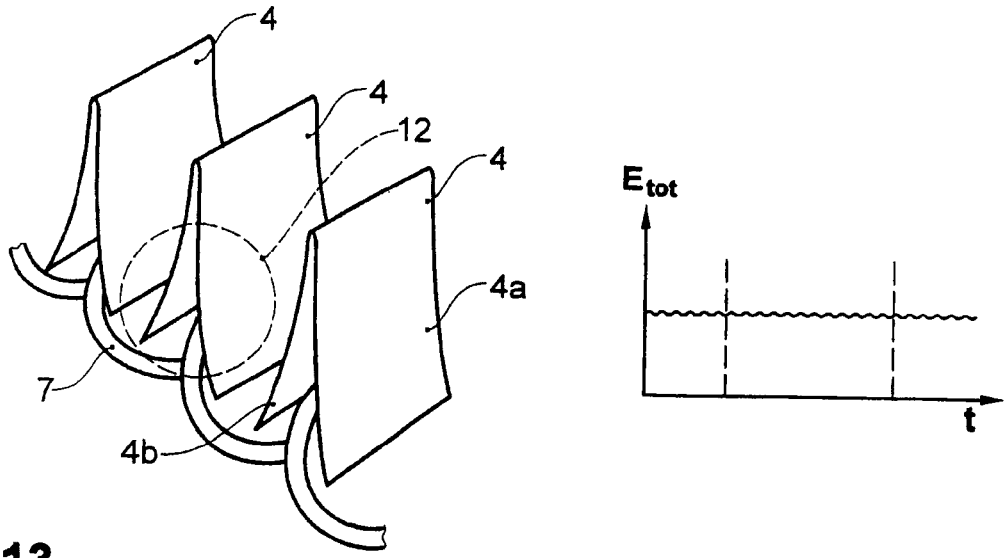
FIGS. 12-14 an opening monitoring system in the case of a collecting device.
Figure 13:
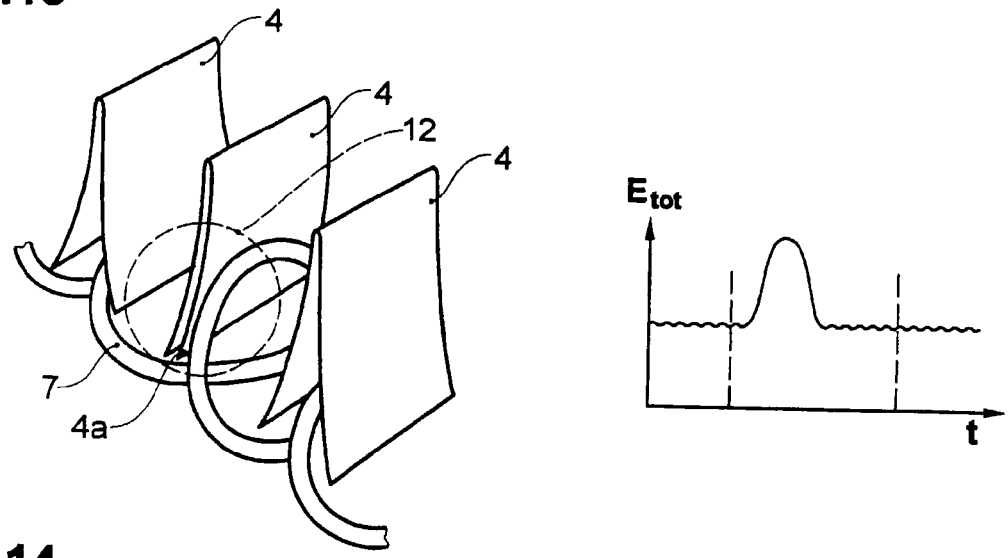
Figure 14:
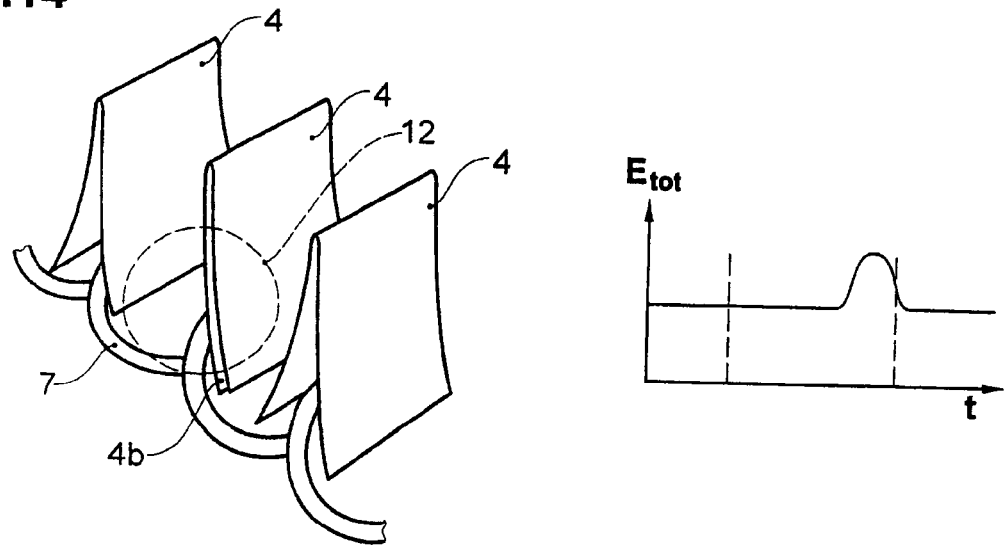

FIGS. 12 to 14 depict configurations, as they are perceived, in a further preferred embodiment of the invention, by a sensor in the position A, thus: a correctly opened sub-product 4 (FIG. 12), a wrongly lying leading half 4*a* (FIG. 13) and a wrongly lying trailing half 4*b* (FIG. 14). The sensor preferably comprises a broader detecting range than a light barrier and, for example, detects light from a range, which approximately corresponds to the width of an opened sub-product 4. This approximately, for example, corresponds to the range 12 indicated in the FIGS. 12 to 14. The sensor therefore measures the light quantity $E_{tot}$ impinging from this range 12. With this very simple measuring principle, nonetheless a differentiated determination of the errors is possible. In doing so, it is assumed that a reflective or light background 11 is located, for example, on the spiral 7 or in the middle range of a saddle 8, and moves along with the sub-product 4 (a similar differentiation is also possible with a stationary reflective or light background). The trajectory over time of the received light quantity $E_{tot}$, is indicated in the FIGS. 12 to 14 respectively, in case of a movement of the sub-product 4 from left to right.

If the arrangement in accordance with FIG. 12 moves past the sensor, then the reflective background 11 essentially remains continuously covered by the two halves 4*a*, 4*b* of the sub-product 4, and the received total intensity $E_{tot}$ in essence remains low for the duration of a complete clocking cycle.

If the arrangement in accordance with FIG. 13 moves past the sensor, then the reflective background 11, because of the missing leading half 4*a*, becomes visible in the first half of the duration of a clocking cycle, and during this time period results in an increase of the received total intensity $E_{tot}$ If the arrangement in accordance with FIG. 14 moves past the sensor, then the reflective background, because of the missing trailing half 4*b*, becomes visible in the second half of a clocking cycle, and during this time period results in an increase of the received total intensity $E_{tot}$.

If the sub-product 4 is completely missing, then the reflecting background becomes visible essentially during the complete clocking cycle and during this time period results in an increase of the received total intensity $E_{tot}$.

By comparing the course of the intensity $E_{tot}$ within the duration of a clocking cycle with a reference curve, therefore the different cases are differentiated and corresponding signals to the control system are triggered. An analogue manner of evaluation is also possible when the sensor is in the position B, C, D, E, or F.

With a line sensor, the viewing range or the viewing line of which is extended in the conveying direction, an even more differentiated detection can be done, using the same principles as shown above. In this, an individual clocked measurement of all values of the line sensor provides similar information to the temporal sequence of measured values of the single sensor described above. A continuous succession of measured values from the line sensor provides correspondingly more information.

In further preferred embodiments of the invention, at one of the described positions A to G a camera is utilised, which provides a two-dimensional black and white picture or a color picture. In preference, an image recording clocked at the conveying clock cycle is carried out, and the recorded picture is compared with a reference picture. In doing so, the pictures are compared as a whole or else as predefined section detail (corresponding, for example, to the anticipated position of bright or reflective background elements 11), and it is possible to compare the raw data or else filtered or transformed picture data or picture characteristics extracted by means of image processing. With this image capturing, it is also possible to differentiate even further and to check whether the sub-product 4 has been opened at the correct point, because as a rule the contents of the individual pages of a printed product are different from one another.

Figure 15:
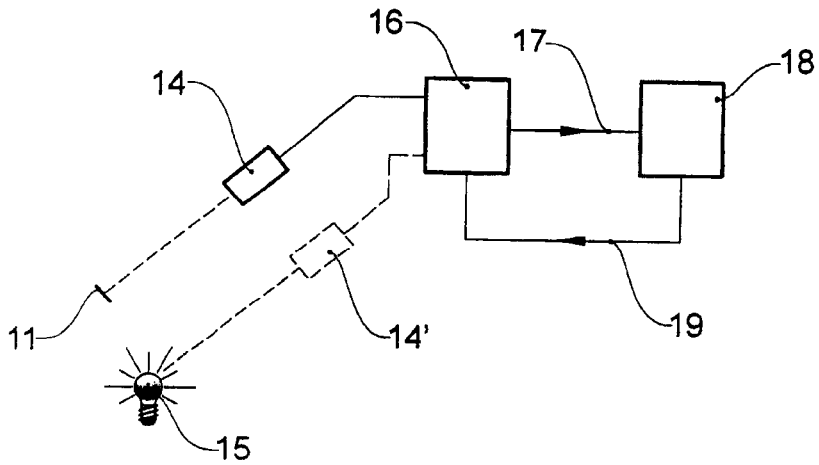
FIG. 15 an opening verification device.

FIG. 15 schematically illustrates an opening checking device, with one or several sensors 14, wherein, for example, a bright or reflective surface 11 is indicated, which is assigned to one of the sensors 14, and indicated (dashed) as being assigned to an optional further sensor 14' is a light source 15. The signals of the sensor or of the sensors are evaluated by a sensor evaluation unit 16, which transmits control signals 17 to a control system 18 of the complete installation for collection. The control signals 17 preferably signal an opening error or optionally also the presence of a sub-product 4. The control system 18 transmits clocking signals 19 to the sensor evaluation unit 16, on the basis of which the sensor evaluation unit 16 synchronises the evaluation with the movement of the conveyed sub-products. The clocking signal, which in the case of the sensor evaluation represents the border between two sub-products 4, or the clocking signal, which is utilised for triggering the sensor data recording, as a rule are displaced relative to a predefined clocking signal of the control system 18 by a constant deviation.

The invention claimed is:

1. Device for opening folded or bound printed products, comprising:

a feeder device for feeding-in individual folded or bound sub-products;

an opening device for opening the sub-products, and an opening verifying installation, which is designed to detect deficiently opened sub-products with an optical device before the sub-products are further processed, wherein sub-products not opened at all are also considered as deficiently opened sub-products, wherein in the case of sub-products detected as being deficiently opened, the device is designed not to carry out the further processing, but to either eject a deficiently opened sub-product or to conduct it back to the opening device once more; and wherein the feeder device is a circulating conveying device, which is designed for the simultaneous transporting of a plurality of sub-products, and the feeder device itself is designed for conducting deficiently opened sub-products back to the opening device once more.

2. Device according to claim 1, wherein the optical device comprises at least one sensor with a sensing direction parallel to the fold of the sub-products.

3. Device according to claim 1, wherein the optical device comprises at least one sensor with a sensing direction essentially vertical to the fold of the sub-products.

4. Device according to claim 1, wherein the optical device comprises at least one sensor with a sensing direction skewed to the fold of the sub-products.

5. Device according to claim 1, wherein the optical device comprises at least one sensor having a narrow sensing angle and is essentially directed to observe a single point.

6. Device according to claim 1, wherein the optical device comprises at least one sensor having a wide sensing angle and therefore senses light from an area corresponding to an entire sub-product.

7. Device according to claim 1, wherein the optical device comprises at least one sensor which is a line sensor or a camera.

8. Device for opening folded or bound printed products, comprising:

a feeder device for feeding-in individual folded or bound sub-products;

an opening device for opening the sub-products, and an opening verifying installation, which is designed to detect deficiently opened sub-products with an optical device before the sub-products are further processed, wherein sub-products not opened at all are also considered as deficiently opened sub-products, wherein in the case of sub-products detected as being deficiently opened, the device is designed not to carry out the further processing, but to either eject a deficiently opened sub-product or to conduct it back to the opening device once more; and wherein for the further processing a collecting device is present, and wherein the feeder device comprises a circulating gripper chain with selectively openable grippers, and wherein the device is arranged to release the sub-products for collection, and, if an opening error is detected, to not release them for collection but to convey them back or at a later point in time to release them for being ejected.

9. Device for opening folded or bound printed products, comprising:

a feeder device for feeding-in individual folded or bound sub-products;

an opening device for opening the sub-products, and an opening verifying installation, which is designed to detect deficiently opened sub-products with an optical device before the sub-products are further processed, wherein sub-products not opened at all are also considered as deficiently opened sub-products, wherein in the case of sub-products detected as being deficiently opened, the device is designed not to carry out the further processing, but to either eject a deficiently opened sub-product or to conduct it back to the opening device once more; and wherein for the further processing an inserting device is present, and wherein for the further processing the inserting device comprises insertion pockets, and wherein the device is equipped to insert a further sub-product into the sub-product providing no opening error is detected, and if an opening error is detected, to not insert a further sub-product and to conduct the sub-product onwards and to bring it to the opening device or to be ejected.

10. Method for opening folded or bound printed products, comprising the following steps:

Feeding-in folded or bound sub-products by means of a feeder device;

opening the sub-products by means of an opening device;

monitoring the nominally opened sub-products for correct opening by means of an opening verifying installation;

in the case a sub-product is identified by the opening verifying installation as being correctly opened, then processing the sub-product further;

in the case a sub-product is identified by the opening verifying installation as not being correctly opened, then ejecting or conducting back the sub-product; and further comprising the step of conducting back the not correctly opened sub-product by means of the feeder device itself, wherein the feeder device is a circulating conveying device, and transports a plurality of sub-products simultaneously.

11. Method according to claim 10, further comprising the step of synchronizing at least one of a capturing and an evaluation of sensor signals from sensors of the opening verifying installation with the movement of the sub-products, wherein the synchronization takes place based on a clocking signal from a control system of the feeder device, or a clocking signal that is automatically generated on the basis of the sensor signals.

12. Method according to claim 11, further comprising the step of capturing the sensor data in accordance with the clocking signal.

13. Method according to claim 11, further comprising the steps of:

continuously recording of the sensor data;

evaluating the sensor data on the basis of their temporal displacement relative to the clocking signal.

14. Method according to claim 13, wherein a sensor of the opening verifying installation in the manner of a light barrier is arranged parallel to the fold of the sub-products, and further comprising the step of detecting of opening errors in accordance with the temporal position of the darkening of the sensor within one clocking cycle.

15. Method according to claim 13, wherein a sensor of the opening verifying installation is arranged at a slant relative to the fold of the sub-products and said sensor detects a total light intensity (E) from a range of respectively one sub-product, and further comprising the step of detecting opening errors in accordance with the intensity trajectory when transporting the sub-product past the sensor during a clocking period.

* * * * *